United States Patent [19]

Anderson

[11] Patent Number: 5,012,878

[45] Date of Patent: May 7, 1991

[54] ROCK BORING MACHINE DRIVE HEAD WITH UP AND DOWN DRILLING CAPABILITY

[75] Inventor: Llewellan Anderson, Renton, Wash.

[73] Assignee: The Robbins Company, Seattle, Wash.

[21] Appl. No.: 417,878

[22] Filed: Oct. 6, 1989

Related U.S. Application Data

[63] Continuation-in-part of Ser. No. 267,527, Nov. 4, 1988, abandoned.

[30] Foreign Application Priority Data

| | | | |
|---|---|---|---|
| Nov. 26, 1987 | [ZA] | South Africa | 87/8873 |
| Nov. 25, 1988 | [AU] | Australia | 25949/88 |
| Nov. 25, 1988 | [CA] | Canada | 584129 |
| Nov. 25, 1988 | [DE] | Fed. Rep. of Germany | 3839898 |
| Nov. 25, 1988 | [FI] | Finland | 885483 |
| Nov. 25, 1988 | [GB] | United Kingdom | 8827553 |
| Nov. 29, 1988 | [ZA] | South Africa | 88/8930 |

[51] Int. Cl.[5] ..... E21B 3/02

[52] U.S. Cl. ..... 175/162; 173/163

[58] Field of Search ..... 175/70, 85, 162; 166/77.5; 173/152, 159, 163, 164

[56] References Cited

U.S. PATENT DOCUMENTS

| | | | |
|---|---|---|---|
| 3,736,993 | 6/1973 | West | 173/152 X |
| 3,754,605 | 8/1973 | Porter et al. | 173/57 |
| 3,797,587 | 3/1974 | Klein | 173/152 |
| 3,800,887 | 9/1974 | West | 173/57 |
| 3,802,057 | 4/1974 | Porter | 29/427 |
| 4,729,260 | 3/1988 | Dudden | 74/752 B |

OTHER PUBLICATIONS

The Robbins Company Drawing No. D37724, Sheets 1 through 4 Inclusive, Dated Mar. 6, 1986, Relating to the Robbins' Model 53R Raise Drill.

*Primary Examiner*—William P. Neuder

*Attorney, Agent, or Firm*—Graybeal, Jensen & Puntigam

[57] ABSTRACT

Drive head apparatus for driving the drill string of a rock boring machine, such apparatus comprising one or two drill string connectors (28) (30) having resilient means such as a coil spring (66) acting therebetween, with respective floating bearings (62) (64) separably secured thereto and with each bearing arrangement comprising respective cooperating, axially fixed bearing seating surfaces (68) (86). Each floating bearing (62) (64) is in the form of a softer metal insert replaceable on the associated connector (28) (30) without replacement of the drill string connector (28) (30). A splined cylindrical drive insert (88) rotatably drives the drill string connector and is separable from the drive body (58) in which it is seated and is axially reversible to swap wear ends or is readily replaceable without need for replacement of the entire drive body (58).

12 Claims, 4 Drawing Sheets

ROCK BORING MACHINE DRIVE HEAD WITH UP AND DOWN DRILLING CAPABILITY

CROSS REFERENCE TO RELATED APPLICATION

This application is a continuation-in-part of U.S. patent application Ser. No. 07/267,527 entitled Drive Head Apparatus For A Rock Boring Machine, filed Nov. 4, 1988, and now abandoned.

BACKGROUND OF THE INVENTION

The rock boring machine drive head apparatus of the present invention has utility for use on rock boring equipment of types well-known in the rock boring field, such as the raise drill shown, for example, in Porter U.S. Pat. No. 3,754,605, Klein U.S. Pat. No. 3,797,587, West U.S. Pat. No. 3,800,887, and Porter U.S. Pat. No. 3,802,057. In such equipments, threaded drill sections are connected end for end to form the drill string and rotatably driven by the drive head while the drive head housing is hydraulically thrust downwardly, or upwardly as the case may be, to urge the drill into the ground being drilled. In such rock boring equipment, it is generally known and highly desirable to have a floating and swivelling bearing for the drive connection in order to absorb overturning forces transmitted by the drill string during drilling, and to guard against any unforeseen loads that might occur during the drilling operation. However, the provision of floating and swivelling bearings in the drive head is expensive, and when these parts become worn, replacement of the worn parts is also expensive and time consuming. The driving components utilized in connection with floating and swivelling bearings commonly include splined drive members, which normally wear in the recoiled position of the bearing, so that after extended use the remainder of the length of the splined teeth along the axial recoil slide path are usually in good condition while those at the recoiled end are worn.

SUMMARY OF THE INVENTION

Objects of this invention include the provision in a rock boring machine drive head apparatus with component structure allowing simple and economical reversal or replacement of worn drive and bearing components, and improved component design rendering the drill string driving elements, particularly the threaded connectors of the drive head into which the threaded drill string engages, less susceptible to wear, yet more resistant to breakage during extended use.

These and other objects, features and advantages of the invention will be apparent to those skilled in the art to which the invention is addressed from consideration of the typical embodiment of the invention herein illustrated and described.

DESCRIPTION OF THE PREFERRED EMBODIMENT

Figure 2:
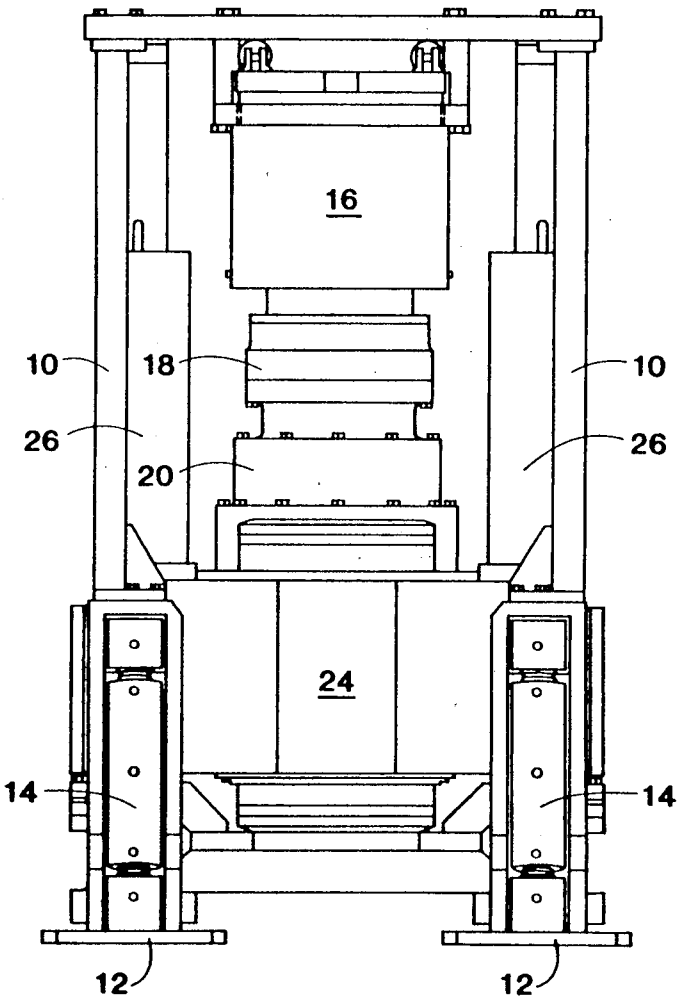
FIG. 2 is a front elevational view thereof.
Figure 1:
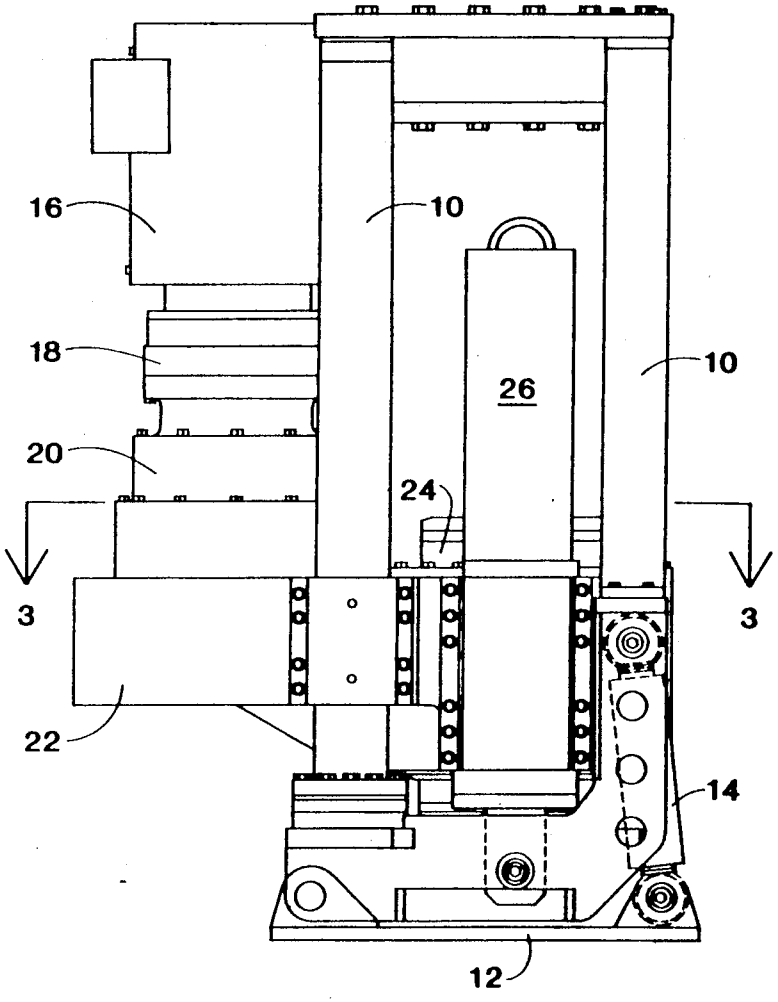
FIG. 1 is a side elevational view of a rock boring machine including a drive head embodying the present invention.
Figure 5:
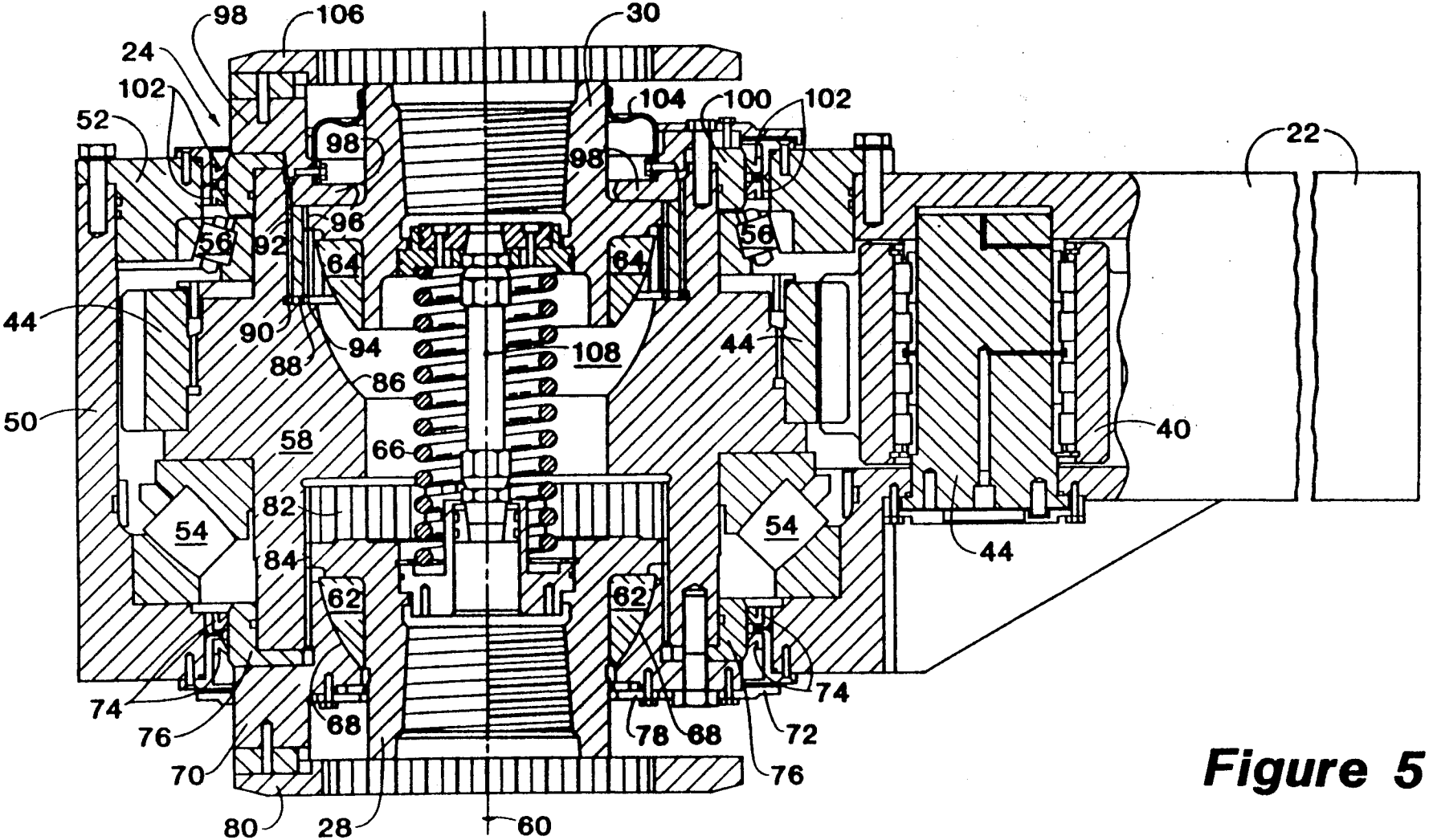
FIG. 5 is a further cross sectional view, with certain parts shown in elevation, showing the driven components of the drive head assembly, taken substantially along line 5—5 of FIG. 3.

In general, the rock boring machine illustrated in FIG. 1 and 2, and in which the components are conventional per se and form no part of the present invention except for the unique construction and arrangement of certain components in the drive head assembly (as shown in FIG. 5), is comprised of a frame assmebly 10, base feet 12, turnbuckle assemblies 14 for adjusting the drill angle, a drive train assembly including electric motor 16, torque limiter 18, auxiliary gear box 20, drive box 22, and drive head 24. Hydraulic cylinders 26 provide thrust and the drive head 24 exerts rotary torque on threaded drill pipe (not shown) connected to either the downwardly facing drill string connector 28 (FIG. 5) or upwardly facing drill string connector 30 in the drive head 24, as more specifically discussed hereinafter.

Figure 3:
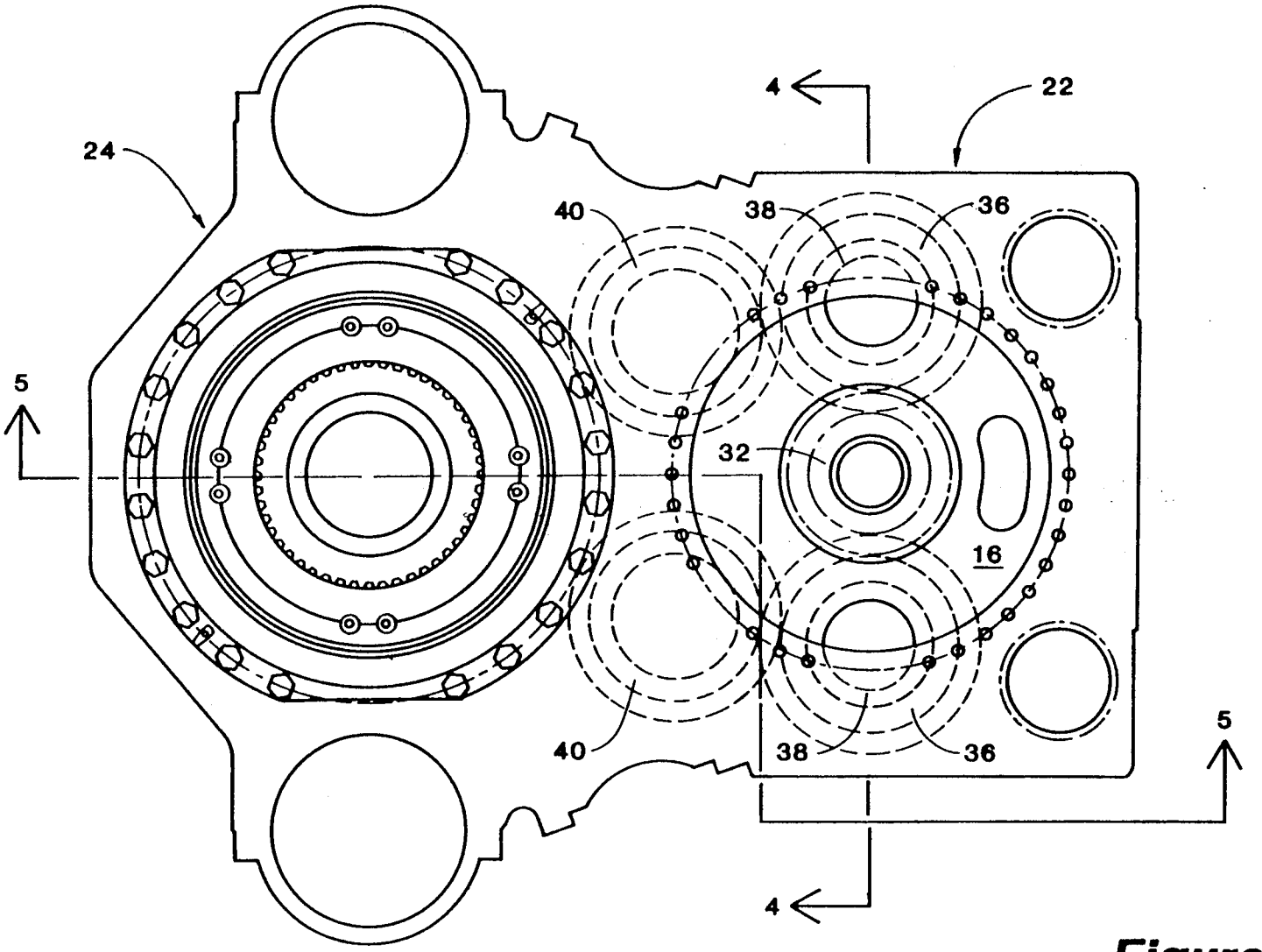
FIG. 3 is a partially schematic, top plan view of the drive box and drive head assembly of the rock borer shown in FIGS. 1 and 2, corresponding to a view taken substantially along lines 3—3 of FIG. 1, with the frame and hydraulic cylinders omitted for simplicity.
Figure 4:
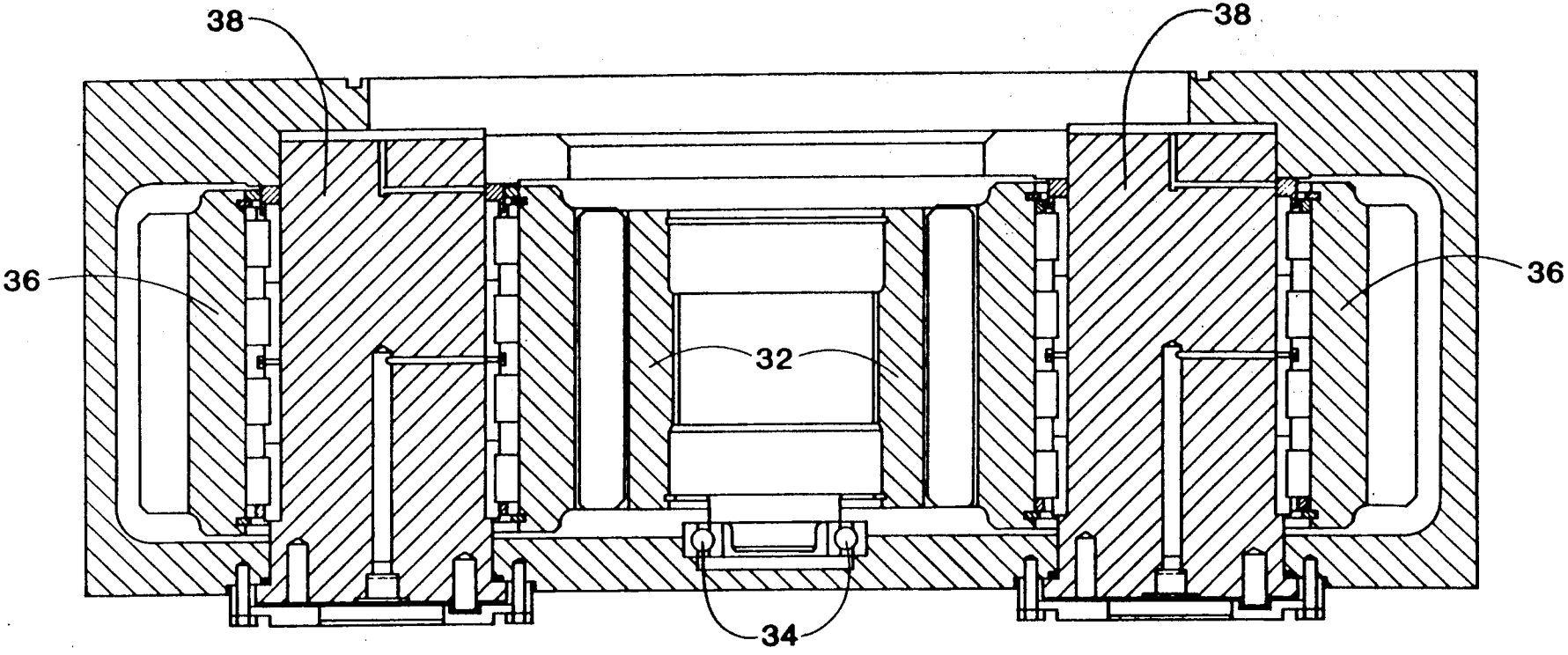
FIG. 4 is a cross sectional view showing certain components of the drive box assembly, taken substantially along line 4—4 of FIG. 3.

FIG. 3 is a partially schematic, top plan view of the drive box 22 and drive head 24, and FIG. 4 is a lateral cross section through the axis of the drive box 22. As best seen in FIG. 4, input pinion 32 is rotatably driven by the output gear (not shown) of the auxiliary gear box 20 and is journaled in bearing 34. Splines on pinion gear 32 interengage with splines on first idler gears 36 journaled on pin 38, which in turn drive second idler gears 40 mounted on pins 42 (one being shown in FIG. 5). Gears 40 in turn, by splined interengagement, drive bull gear 44 in the drive head (FIG. 5).

Drive head 24 comprises a stationary housing 50 including bolted on top member 52, within which the rotated components of the drive head are supported by spherical roller thrust bearings 54 and tapered roller bearings 56. Rotated drive body 58 carries and is rotated by bull gear 44 about an axis of rotation indicated at 60 which is nominally coincident with the center axes of lower and upper drill string connectors 28, 30. Each drill string connector 28, 30 carries a respective spheroidal bearing member 62, 64, which is replaceably secured thereon and which is fabricated of relatively softer metal such as aluminum bronze alloy. The lower and upper drill string connectors 28, 30 are under resilient, compressive force exerted axially by compression spring 66 and the bearing body 62 on connector 28 is urged against and may float, i.e. swivel, somewhat with respect to spheroidal bearing surface 68 which is part of lower wrench body 70. The lower end assembly is completed by lower splash guard 72, seal ring 76 (against which seals 74 on the housing 50 ride), retainer 78, and splined ring 80, against which the conventional wrenching mechanism (not shown) used to connect and disconnect the drill pipe from the drill string connector 28 seats. As will be evident, the structural arrangement is such that the connector 28, although rotationally keyed to the drive body 58 by splines 82 in the body 58 and 84 on the connector 28, may move both axially and tiltably a limited degree relative to the drive body 58. Similarly, the spherical bearing 64 on the upper drill string connector 30, when the upper connector 30 is connected to an upwardly directed drill string and under its weight is urged downwardly against the force of spring 66, rides on the spheroidal bearing surface 86, and the upper drill string connector 30 can rock or swivel somewhat relative to the drive body 58 by reason of the configuration of the bearing 64 and bearing surface 86 and the driving connection between the drive body 58 and the drill string connector 30. According to the invention, this driving connection comprises a generally cylindrical spline insert 88 which has external splines 90 meshing with internal splines 92 on the drive body 58 and has internal splines 94 meshing with external splines on the connector 30. As will be evident, relative axial movement between the drive body 58 and drill string connector 30 can be accommodated by the splines 94, 96 without loss of driving connection between the body 58 and connector 30. As will also be evident, the ring-like spline insert 88 is readily reversible and readily replaceable.

The top end components around the upper drill string connector 30 include a wrench body 98, seal ring 100 against which seals on the stationary housing component 52 act, seal sleeve 104, and keyed spline ring 106, which functions as a component of the wrenching system for connecting and disconnecting a drill pipe from the drill string connector 30 in like manner as ring 80 associated with the lower drill string connector 28. As will be noted, the portion of the wrench body 98 surrounding the drill string connector 30 immediately above the cylindrical spline insert 88 serves to retain the spline insert in position yet is readily removable from the drill string connector 30. On its removal, the cylindrical splined insert 88 can simply be removed axially upwardly and reversed end for end to bring other portions of the splines 94 into normal engagement with the splines 96 on the connector 30. It is to be recognized in this regard that most of the wear on the splines 94 will occur in the lowermost portion thereof because this is the normal position of the connector 30 when under the load of an upwardly directed drill string and with upper bearing 64 engaging bearing surface 86. If the splines were formed directly in the drive body 58, when the splines became unduly worn it would normally require replacement of the entire drive body 58, whereas, with the construction shown, all that needs to be done is to reverse the splined sleeve 88. Similarly, the respective spheroidal bearings 62, 64 on the connectors 28, 30 are major points of wear and, with the component construction shown, the bearings 62, 64 are readily removable and replaceable without replacement of the entire respective drill string connector 28 or 30.

As will be understood, the drill string connectors 28, 30 are in the form of a box section of a threaded drill pipe of conventional form, and configured to receive the pin of a drill pipe section with drill pipe sections being made up to form the drill string, all in a conventional manner. Each such connector 28, 30 is secured to the opposite end of the coil spring 66 so that recoil can occur with the associated drive structures sliding inwardly into the housing 58 against the spring biasing, with appropriate axial movement occurring between the splines 82, 84 with respect to the lower connector 28 and between the splines 94, 96 with respect to the upper connector 30. A flexible hose and sliding piston interconnection 108 is also provided between the drill string connectors 28, 30 for use in certain operational instances to permit fluid injection into a drill string, if desired, through a swivel connection, also in a manner conventional per se.

In use, the spheroidal bearings 62, 64 and associated bearing surfaces 68, 86, if properly greased and kept dirt free, should not be wear parts. But should there be wear the inserts 62, 64 can be removed and replaced without the necessity for replacing the hardened steel components, i.e. the expensive drill string connector with treated bearing surfaces or replacing the heat treated bearing surfaces in the drive body 50 or lower body 70. The drive body 58 and the lower wrench body 70 in which the bearing surface 68 is formed can thus be fabricated to be more wear resistant with the intention that the inserts 62, 64 will take the wear if any wearing takes place.

It is also notable in the components configurations as shown in FIG. 5 that the drill string connectors 28, 30 have approximately uniform cross sectional thickness throughout. This in turn facilitates substantially uniform hardness throughout, i.e. with heat treatment hardening, in a manner conventional per se, occurring to substantially uniform depth throughout.

As indicated earlier, the splined insert 88 through which the upper drill string connector 30 is driven when the upper drill string connector is the operational drive string element, is axially removable upwardly out of its seating in the drive body 58 so that if wear occurs predominantly in one end portion of the splines 94 the insert 88 can simply be axially reversed or if it ultimately wears out it can be readily replaced without the necessity of replacing of the entire drive body 58. Although not shown, it will be understood that a similar drive insert or drive ring can be provided and be readily reversible or replaceable in like manner with respect to the lower drill string connector 28, i.e. by arranging such a reversible and replaceable externally and internally splined insert between the drive body splines 82 on drive body 58 and the splines 84 on the lower connector 28.

These and other modifications, adaptations and variations will occur to those skilled in the art to which the invention is addressed, within the scope of the following claims.

What is claimed is:

1. Drive head apparatus for a drill string of a rock boring machine, said apparatus comprising a drill string connector securable to drive a drill string, said connector being floatingly mounted in a housing to recoil in use against resilient means while being rotated by spline means, there being an axially fixed bearing surface behind the drill string connector having a co-operant floating bearing on the drill string connector engageable with and rotatable with the fixed bearing surface, the floating bearing being separably secured to the drill string connector so as to be replaceable without replacement of the drill string connector.

2. Apparatus as claimed in claim 1, in which the drill string connector has an approximately uniform cross-sectional area throughout so as to have uniform hardening treatment throughout the connector.

3. Apparatus as claimed in claim 2, arranged for use with a bi-directional boring machine and including a further drill string connector floatingly and swivellably mounted at an opposite side of the housing to the first drill string connector, with the resilient means arranged therebetween.

4. Apparatus as in claim 3, wherein said resilient means is in the form of a coil spring.

5. Apparatus as claimed in claim 1, arranged for use with a bi-directional boring machine and including a further drill string connector floatingly and swivellably mounted at an opposite side of the housing to the first drill string connector, with the resilient means arranged therebetween.

6. Apparatus as in claim 5, wherein said resilient means is in the form of a coil spring.

7. Apparatus as claimed in claim 1, further comprising a splined tooth ring drive for the drill string connector and a ring body in which the ring drive is replaceably seated, said ring drive being separable from the ring body and reversible in its seat to have one axial end interchangeable with the other.

8. Apparatus as claimed in claim 3, further comprising a splined tooth ring drive means for one of the drill string connectors and a ring body in which the ring drive is replaceably seated, said ring drive being separable from the ring body and reversible in its seat to have one axial end interchangeable with the other.

9. Apparatus as claimed in claim 5, further comprising a splined tooth ring drive for a drill string connector and a ring body in which the ring drive is replaceably seated, said ring drive being separable from the ring body and reversible in its seat to have one axial end interchangeable with the other.

10. Apparatus as claimed in claim 6, further comprising a splined tooth ring drive for a drill string connector and a ring body in which the ring drive is replaceably seated, said ring drive being separable from the ring body and reversible in its seat to have one axial end interchangeable with the other.

11. In a rock boring machine, means for axially thrusting and means for rotating a drill string connector, such rotating means including a drive head assembly with a rotatable drive body in which the drill string connector is arranged to be movable axially and swivelly, with compression spring means acting axially on the connector, axially extending spline means interconnecting the drive body and the connector, and interengageable spheroidal bearing means and bearing surfaces between the drive body and the connector, the improvement wherein the driving interconnection between said drive body and said drill string connector comprises separable, reversible and replaceable spline insert means of generally cylindrical shape with external splines intermeshing with internal splines on said drive body and internal splines intermeshing with external splines on said drill string connector.

12. In a rock boring machine, means for axially thrusting and means for rotating a drill string connector, such rotating means including a drive head assembly with a rotatable drive body in which the drill string connector rotates with the body and is arranged to be movable axially and swivelly therein, with compression spring means acting axially on the connector, axially extending spline means interconnecting the drive body and the connector, and interengageable spheroidal bearing means and bearing surfaces between the drive body and the connector, the improvement wherein said spheroidal bearing means is a separately replaceable component of the drill string connector and is of a relatively softer metal so as to wear more readily than the associated bearing surface engaged thereby.

* * * * *